United States Patent [19]

Crimmins et al.

[11] 3,948,506

[45] Apr. 6, 1976

[54] TUNED CARD WEIGHT

[75] Inventors: William M. Crimmins, Vernon Hills; Robert E. Petterec, Lindenhurst, Ill.

[73] Assignee: Xerox Corporation, Stamford, Conn.

[22] Filed: Feb. 18, 1975

[21] Appl. No.: 550,327

[52] U.S. Cl. ..... 271/165; 271/126

[51] Int. Cl.[2] ..... B65H 1/10

[58] Field of Search ..... 271/34, 35, 109, 119, 121, 271/126, 165, 166, 167; 221/232, 279

[56] References Cited

UNITED STATES PATENTS

| | | | |
|---|---|---|---|
| 2,120,247 | 6/1938 | Funk et al | 271/119 |
| 2,401,719 | 6/1946 | Braun | 271/165 |
| 2,938,722 | 5/1960 | Luning | 271/165 |

*Primary Examiner*—Evon C. Blunk
*Assistant Examiner*—Robert Saifer

[57] ABSTRACT

A tuned card weight for biasing a stack of cards in a card feeder includes: (a) a base section having a pair of parallel edges, one of the edges having an extension forming an acute angle with one side of the section; (b) an elastomer cantilever coupled to the other side of the base section along the other of the edges, the cantilever having a handle at its free end; and (c) a metal rod extending through the handle for providing the resulting structure with a damped resonant frequency. The resonant frequency is provided such that it is greater than the rate at which the feeder operates.

5 Claims, 2 Drawing Figures

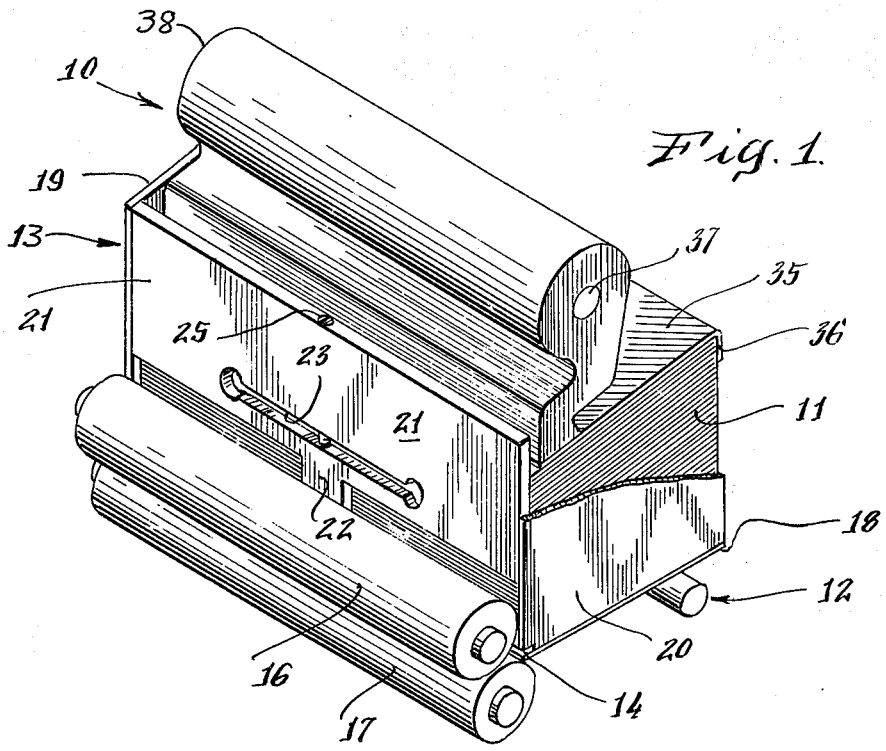
Fig. 1.
Fig. 2.
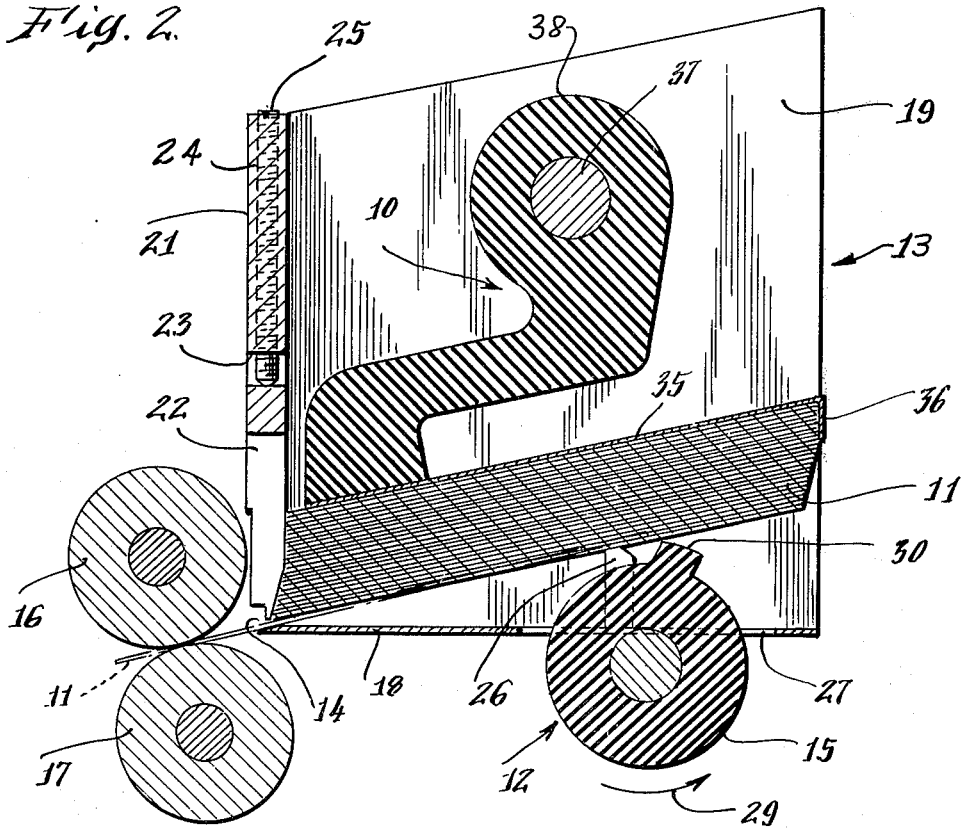

TUNED CARD WEIGHT

The subject invention relates to card weights such as are used to bias cards which have been loaded into a card feeder.

In data processing equipment of the type wherein information is located on cards, the cards are usually fed sequentially, from a stack, to a conveying system which moves the cards to at least a first processing station. More specifically, in known card feeders a vertical stack of cards is loaded into a hopper and a cyclically driven friction drive engages and drives the lowermost card of the stack through a slot or throat in the hopper. As the cards emerge from the throat they enter the nip of a pair of rollers, one of which is driven, and are conveyed towards a processing station at a predetermined speed. Typically, the friction drive is provided by a driven roller mounted under the stack, the roller having a radial projection which engages and drives, through a hole in the bottom of the hopper, a different card for part of a cycle each time it revolves. A radial projection is used so that only the projection is capable of engaging and driving the cards. Structurally, the projection extends an amount sufficient to engage a card along a segment of its travel and in so doing momentarily biases the stack of cards upwardly. Since an engaged card bears the weight of other cards in the stack the friction between the projection and the lowermost card causes the card to be moved through the throat and into the nip. As the cards in the stack are fed the weight on the lowermost card in the stack decreases and the friction between the projection and the lowermost card decreases. In consequence, unless a weight is placed on the top of the stack of cards, slippage between the projection and the lowermost card occurs and the rate at which cards are fed decreases. It should be noted that each time a card is fed the stack is provided with an impulse which lifts the weight and the weight serves its function only so long as its settling time is less than the period of time it takes for the roller to proceed through a cycle. In known apparatus the magnitude of the settling time is solely dependent on the magnitude of the weight.

It is an object of the present invention to provide a tuned card weight for biasing a stack of cards in a periodic card feeder, the damped resonant frequency of the card weight being greater than the feed frequency to provide a bias to the stack as cards are fed.

It is another object of the present invention to provide a card weight having means for aligning at least the last group of cards to be processed by a card feeder.

In summary, the invention provides a tuned card weight for biasing a stack of cards in a card feeder capable of feeding cards at a predetermined rate comprising: (a) a base section having at least one pair of opposing edges, one of the edges having an extension forming an acute angle with one side of the section; (b) a cantilever coupled to the other side of the base section adjacent the other of the edges; and (c) means connected to the cantilever for providing the resulting structure with a predetermined damped resonant frequency, said frequency being greater than said rate.

Additional objects and features of the invention will become apparent by reference to the following description in conjunction with the accompanying drawings, in which:

FIG. 1 is a perspective view of a card weight, according to the invention, biasing a stack of cards in a card feeder, a part of the card feeder having been broken away to more fully disclose the weight; and FIG. 2 is a cross-sectional view taken along line 2—2 in FIG. 1 after some of the cards have been fed.

Referring to FIGS. 1 and 2, a card weight 10, according to the invention, is shown biasing a stack of data bearing cards 11 in a card feeder 12. Card feeder 12 includes a hopper 13 having a throat 14, a feed roll 15 which extends into the hopper for driving cards through the throat (see FIG. 2) and a pair of nip rollers 16 and 17 positioned for engaging and forwarding cards exiting through the throat.

In this embodiment, hopper 13 includes a horizontally disposed rectangular base 18, a pair of side walls 19 and 20 extending upwardly from opposite edges of the base, and a wall segment 21 extending from the top of wall 19 to the top of wall 20 to define an opening. Segment 21 includes a tab 22 extending downwardly into near contact with base 18, a horizontal slot 23 above the tab, and a vertically tapped hole 24 extending from the slot to the top of the segment. With this arrangement, a screw 25 engaged with the tapped hole may be used to control the size of the throat 14. Base 18 includes a number of spacers 26 (only one shown) for supporting the cards 11 such that they slope towards the throat, and a hole 27 through which feed roll 15 extends. Feed roll 15 is a cylindrical structure having a radial projection 30, the structure being disposed for rotation about an axis parallel to the throat. As may be seen in FIG. 2, roll 15 is mounted such that projection 30 will strike the lowermost card in the stack when it is rotated in the direction of arrow 29 and will frictionally move the lowermost card in the stack through throat 14 and into engagement with rollers 16 and 17. To enhance the frictional engagement between the projection and cards, roll 15 may be manufactured from urethane or some other material having a high coefficient of friction.

To contribute to the normal force required between the lowermost card and the projection for a friction drive relationship card weight 10 is disposed on top of the stack of cards 11. Structurally, weight 10 includes a base 35 section having at least one pair of parallel edges, one of the edges having an extension 36 forming an acute angle with one side of the base for engaging the elevated edges of at least some of the cards. A cantilever 38 is connected to the other side of the base section along the other of the edges and includes at its free end an extension which is suitable as a handle and as a support for a cylindrical member 37 which provides the card weight with a predetermined resonant frequency. Weight 10 has a uniform cross-section and its component parts are selected to provide a center of gravity which, when the weight is placed on cards 11, is vertically aligned with the center of gravity of the cards. This arrangement prevents distortion of the cards 11 and prevents a shifting of forces, which are exerted on the lowermost card, as cards are fed.

In a particular card weight manufactured in accordance with the foregoing description the base 35 and extension 36 were made from sheet metal, the cantilever was made from an elastomer, i.e., ethylene propylene (EPDM), and member 37 was made from a metallic rod. The card weight was designed to exhibit a damped resonant frequency of 13 cycles/sec. and was used with a card feeder operating at a feed rate of 3 cards/sec. During operation of the apparatus it has been observed that the motion of the base very closely agrees with the motion created when projection 30 is in contact with the card stack. Therefore, the lowermost card in the stack stays in contact with the projection during feeding of the card. It has also been observed that the handle portion of the cantilever is displaced when the projection strikes the lowermost card and the displacement reverses its direction during maximum displacement by the projection. Thereafter, the handle displays a damped oscillation which lasts for a total of about 4 cycles before another card is fed. The damped oscillations dissipate energy. Therefore, it will be appreciated that the impulse energy exerted on the stack of cards by projection 30 is at least partially transferred to the weight and this minimizes displacement of cards in the stack. In consequence, cards in the stack may be fed at a uniform rate, particularly during the feeding of the last few cards in the deck.

It is to be understood that the description herein of a preferred embodiment of a card weight, according to the invention, is set forth as an example thereof and is not to be construed or interpreted as a limitation on the claims which follow and define the invention.

What is claimed is:

1. A tuned card weight for biasing a stack of cards in a card feeder capable of feeding cards at a predetermined rate, comprising:

a. a base section having at least one pair of opposing edges, one of the edges having an extension forming an acute angle with one side of the section;

b. a cantilever coupled to the other side of the base section adjacent the other of the edges; and c. means connected to the cantilever for providing the resulting structure with a predetermined damped resonant frequency, said frequency being greater than said rate.

2. A tuned card weight as defined in claim 1 wherein said cantilever includes at its end an extension suitable for use as a handle and said means (c) is supported by said extension.

3. A tuned card weight as defined in claim 1 wherein said opposing edges are parallel and said cantilever has a uniform cross-section in theoretical planes perpendicular to said edges.

4. A tuned card weight as defined in claim 3 wherein said means (c) include a rod extending in parallel with said edges.

5. A tuned card weight as defined in claim 4 wherein said cantilever is formed from an elastomeric material and said rod is metallic.

* * * * *